United States Patent [19]

Frankenfeld et al.

[11] Patent Number: 4,997,585

[45] Date of Patent: Mar. 5, 1991

[54] AROMATIC SUBSTITUTED BENZOTRIAZOLE CONTAINING LUBRICANTS HAVING IMPROVED OXIDATION STABILITY

[75] Inventors: John W. Frankenfeld, Hoboken, N.J.; Alan R. Katritzky, Gainesville, Fla.

[73] Assignee: Exxon Research and Engineering Company, Florham Park, N.J.

[21] Appl. No.: 502,582

[22] Filed: Mar. 30, 1990

[51] Int. Cl.[5] ..... C10M 133/44

[52] U.S. Cl. ..... 252/50; 252/405

[58] Field of Search ..... 252/50, 405; 548/257, 548/260, 261

[56] References Cited

U.S. PATENT DOCUMENTS

| | | | |
|---|---|---|---|
| 3,849,433 | 11/1974 | Butula | 252/50 |
| 4,701,273 | 10/1987 | Brady et al. | 252/50 |
| 4,880,551 | 11/1989 | Doe | 252/50 |

FOREIGN PATENT DOCUMENTS

| | | | |
|---|---|---|---|
| 6163195 | 12/1981 | Japan | 252/50 |

*Primary Examiner*—Jacqueline V. Howard

*Attorney, Agent, or Firm*—John W. Ditsler

[57] ABSTRACT

The addition of certain aromatic substituted benzotriazole compounds to a lubricant imparts improved oxidation stability to the lubricant. The oxidation stability is particularly enhanced when the substituents on the substituted aromatic ring are strong electron donors.

26 Claims, No Drawings

AROMATIC SUBSTITUTED BENZOTRIAZOLE CONTAINING LUBRICANTS HAVING IMPROVED OXIDATION STABILITY

BACKGROUND OF THE INVENTION

1. Field of the Invention

This invention concerns lubricating compositions having improved oxidation stability due to the presence of an aromatic substituted benzotriazole containing an electron donating substituent.

2. Description of Related Art

Oxidation stability is an important requirement for all lubricants, including automotive lubricating oils, industrial oils, and greases. The major cause of oxidative instability is the auto-oxidative breakdown of hydrocarbons in the lubricants and the concomitant formation of acids and other undesirable oxygenated species, including sludge. Auto-oxidative breakdown is strongly catalyzed by traces of metal ions (especially copper and iron) which become solubilized when the lubricant contacts a metal surface. One way to control auto-oxidation is to add one or more metal deactivators to the lubricant. In general, these deactivators prevent such undesirable catalytic reactions from occurring in two different ways: The metal deactivators form impervious films on the metal surface, thereby preventing dissolution of the metal ions (these are called "film forming metal passivators"), or the metal deactivators form complexes with solublized metal ions, thus rendering them inactive as catalysts (these are called "soluble metal deactivators").

Certain benzotriazole derivatives are known metal deactivators of the film forming type. For example, U.S. Pat. No. 3,697,427 discloses the use of benzotriazole and certain alkyl benzotriazoles (e.g. methylene bis-benzotriazole) in synthetic lubricating compositions.

Similarly, U.S. Pat. No. 3,790,481 discloses a polyester lubricating base stock that contains, among other additives, a copper passivator selected from methylene bis benzotriazole, benzotriazole, alkyl benzotriazoles, and naphthotriazole.

U.K. Patent 1,514,359 discloses the use of certain bis-benzotriazoles in functional fluids wherein the benzotriazole moieties are connected by alkylene and cycloalkylene groups, carbonyl groups, a sulphonyl group, oxygen, or sulfur atoms. The benzotriazole moieties also have dialkylamino methyl groups attached.

U.K. Patent 1,061,904 discloses the use of certain substituted benzoimidazoles and benzotriazoles as metal deactivators in lubricating compositions and functional fluids.

However, none of these patents (the disclosures all of which are incorporated herein by reference) disclose the particular aromatic substituted benzotriazole containing lubricant compositions described hereafter.

SUMMARY OF THE INVENTION

This invention concerns lubricant compositions containing oxidation reducing amounts of certain benzotriazoles. More specifically, we have discovered that the oxidation stability of a lubricant can be improved when the lubricant contains a minor amount of an additive having structure I shown below:

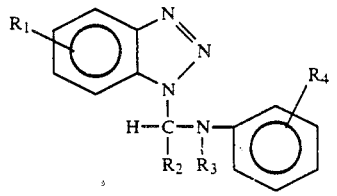

(I)

wherein $R_1$, $R_2$, and $R_3$ may be the same or different and are hydrogen or an alkyl group, and $R_4$ is an electron donor.

DETAILED DESCRIPTION OF THE INVENTION

The aromatic substituted benzotriazole additives of this invention have structure (I) shown above where $R_1$, $R_2$, $R_3$, and $R_4$ ($R_1$–$R_4$) are defined as above. Although the number of carbon atoms in the alkyl groups of $R_1$–$R_3$ can vary broadly, the alkyl groups in $R_1$–$R_3$ will generally contain from 1 to 20, preferably from 1 to 10, and more preferably from 1 to 4, carbon atoms. In addition, the alkyl groups in $R_1$–$R_3$ may be straight or branched, but a straight carbon chain is preferred. Preferably, $R_1$ is hydrogen or a straight chain alkyl group having from 1 to 4 carbon atoms; $R_2$ is hydrogen; and $R_3$ is hydrogen or a straight chain alkyl group having from 1 to 4 carbon atoms. Most preferably, $R_1$ is hydrogen or $CH_3$; $R_2$ is hydrogen; and $R_3$ is hydrogen, $CH_3$, or $C_2H_5$. If $R_1$ is an alkyl group, the group should most preferably be in the 5 numbered position according to the structure shown below (which is the benzotriazole portion of structure (I)):

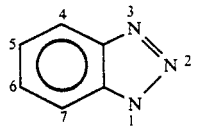

An alkyl group in either the 4 or 7 numbered position is less desirable because the effectiveness of the additive for oxidation stability will be reduced.

$R_4$ is a strong electron donor. One way to evaluate the electron donating property of the substituents on the aromatic ring attached to the amine (rather than the triazole) nitrogen (R4) is by using the "substituent constants" described in *Physical Organic Chemistry*, J. Hine, McGraw-Hill Publishing, New York, 1956, at pages 66–80, the disclosure of which is incorporated herein by reference. As described on page 71 therein, electron donating substituents have negative substituent constants whereas electron withdrawing substituents have positive substituent constants. In accordance with this invention, $R_4$ in structure I is selected from substituents that have substituent constants of less than 0. The more negative the substituent constants, the greater the tendency of $R_4$ to donate electrons. Hence, $R_4$ is preferably substituents that have more negative substituent constants.

Examples of suitable substituents for $R_4$ are alkyl, amido, amino, hydroxy, or thiol groups, or alkyl substituted derivatives thereof. Substituents having alkyl, hydroxy, or substituted derivaties thereof are preferred. Suitable alkyl substituted derivatives include alkoxy, aryloxy, dialkylamino, or alkylthiol groups, and the like. Alkoxy substituted derivatives (such as methoxy, ethoxy, and the like) are preferred, with methoxy being particularly preferred. Although the number of carbon atoms in $R_4$ can also vary like those in $R_1$–$R_3$,$R_4$ will generally contain from 1 to 20 carbon atoms, which are preferably straight chained rather than branched. $R_4$ may be the same or different than $R_1$–$R_3$. Preferably, $R_4$ will have from 1 to 10, and most preferably from 1 to 4 carbon atoms. $R_4$ may also have from 1 to 3 carbon atoms.

Compounds having structure (I) can be obtained, for example, by reacting benzotriazole (or a substituted benzotriazole), formaldehyde (or an alkyl aldehyde), and an amine in an aqueous medium or in various solvents (e.g. ethanol, methanol, or benzene). Such preparation techniques as well known in the art and are described, for example, in U.K. Patent 1,061,904.

In general, the lubricants of this invention will comprise a major amount of a lubricating oil basestock (or base oil or oil of lubricating viscosity) and a minor amount of the aromatic substituted benzotriazole additives having structure (I). If desired, other conventional lubricant additives may be present as well.

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1octenes), poly(1-decenes), etc., and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like.

Silicon-based oils (such as the polyakyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating base oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The amount of benzotriazole added to the lubricant compositions of this invention need only be an amount sufficient to increase the auto-oxidative stability of the lubricant relative that obtained in the absence of the additive. In general, the amount of additive can range from about 0.01 up to about 5 weight % or more (based on the total weight of the composition), depending upon the specific application of the lubricant. Typically, however, from about 0.01 to about 2 wt. % of the additive will be used to ensure solubility of the additive and for economic considerations. Preferably, the amount of additive used will range from about 0.01 to about 1, more preferably from about 0.02 to about 0.2, weight %.

Other additives may be present in the lubricant compositions of this invention as well, depending upon the intended use of the composition. Examples of other additives include ash-free detergents, dispersants, corrosion preventing agents, antioxidants, pour-point depressants, extreme pressure agents, viscosity improvers, colorants, antifoamers, and the like.

Lubricants containing the benzotriazole additives of this invention can be used in essentially any application requiring a lubricant having good oxidation stability. Thus, as used herein, "lubricant" (or "lubricant composition") is meant to include automotive lubricating oils, industrial oils, greases, and the like. For example, the lubricant compositions of this invention can be used in the lubrication system of essentially any internal combustion engine, including automobile and truck engines, two-cycle engines, aviation piston engines, marine and railroad engines, and the like. Also contemplated are lubricants for gas-fired engines, alcohol (e.g. methanol) powered engines, stationary powered engines, turbines, and the like.

However, the lubricant compositions of this invention are particularly useful in industrial oils such as turbine oils, gear oils, compressor oils, hydraulic fluids, spindle oils, high speed lubricating oils, process oils, heat transfer oils, refrigeration oils, metalworking fluids, and the like.

This invention will be further understood by reference to the following examples which are not intended to restrict the scope of the claims. In Examples 1–3, various benzotriazole compounds were added to samples of a lubricating oil. Several different oxidation tests were then performed on the samples to determine their oxidation stability. Unless otherwise stated, the lubricating oil used in Examples 1–3 was a partially formulated lubricating oil consisting of a Solvent 150 Neutral base oil containing 0.04 wt. % of a rust inhibitor and 0.2 wt. % of a phenolic antioxidant. The benzotriazole compounds tested included a commercially available benzotriazole additive believed to have structure II shown below

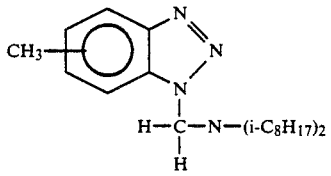

(II)

as well as various aromatic substituted benzotriazole additives having structure I, including (for comparison) additives in which $R_4$ contained an electron withdrawing substituent ($NO_2$). The following benzotriazole derivatives were also tested:

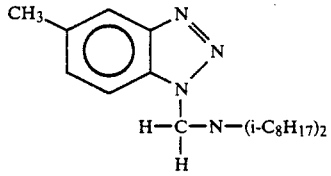

(III)

-continued

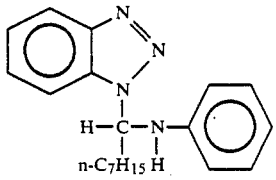

(IV)

In Examples 1–3, one or more of the following tests were performed to determine the oxidation stability of the various additives tested:

Modified ASTM D2440 Oxidation Test

This test measures the effectiveness of the additives to passivate a solid metal catalyst. In this test (which is a modification of ASTM Oxidation Test Method D2440), the oil is contacted with $O_2$ (flowing at 1 liter/hr) at 120° C. for 164 hours in the presence of a solid copper wire catalyst. The Total Acid Number (TAN) and the weight % sludge produced during the test was determined and the Total Oxidation Products (TOP) calculated using the following equation:

$$TOP = \frac{TAN}{3} + \text{weight \% sludge}$$

The TOP is a measure of the degree of oxidation—the lower the TOP, the more effective the additive is as an antioxidant.

CIGRE (IP 280) Oxidation Test

The CIGRE test measures the ability of an additive to deactivate soluble copper and iron. Film forming additives which are effective against solid metals in the D2440 test may not perform well in the CIGRE test. In this test, the oil is oxidized at 120° C. for 164 hours in the presence of a soluble copper naphthenate catalyst or a catalyst of soluble copper naphthenate and soluble iron naphthenate. An oxygen flow rate of 1 liter/hr is maintained during the test. The TOP is calculated as in the D2440 test and has the same significance.

Rotary Bomb Oxidation Test (RBOT)

This test is described in ASTM D2272 and measures the effectiveness of an additive to deactivate a solid copper catalyst. In this test, the oil is oxidized in the copper wire catalyst and water. The "life" of the test oil is the time required for the oil to react with a given amount of oxygen. The longer the "life", the more stable the oil formulation (i.e. the more effective the antioxidant).

Universal Oxidation Test (UOT)

This is a high temperature oxidation test designed to determine the effectiveness of additives to deactivate a mixture of solid copper and iron catalysts. Air is blown through the oil at a rate of 3.0 liters/hr and at a temperature of 135° C. A water condenser is employed to condense volatile products. The effectiveness of the antioxidant is determined by measuring the time required for the acid titre of the oil to increase by 0.5 neutralization number (mg KOH/g oil). The longer the life, the more effective the antioxidant.

EXAMPLE 1

ASTM D2440 CIGRE Tests on the Partially Formulated Oil

ASTM D2440 and CIGRE tests were performed on several samples of the partially formulated oil to which various benzotriazole compounds had been added. The initial concentration of each additive in this example (and in Examples 2 and 3) was about $2\times10^{-4}$ moles/100 g oil to ensure that the additives were tested on a equal molar basis. As such, the wt. % of the additives in the tables will vary with the molecular weight of the additive. The results of these tests are shown in Table 1.

TABLE 1

| D2440 and CIGRE Test Results On Partially Formulated Oil | | | | | | | | | |
|---|---|---|---|---|---|---|---|---|---|
| | | Wt % | Substituents in Structures I–IV | | | | D-2440 | CIGRE TOP | |
| Run No. | Additive | Additive | $R_1$ | $R_2$ | $R_3$ | $R_4$ | (TOP) | Cu | Cu + Fe |
| 1 | — | 0 | — | — | — | — | 3.0 | 2.1 | 4.0 |
| 2 | Structure II | 0.08 | $CH_3$ | H | i-$C_8H_{17}$ | i-$C_8H_{17}$ | 0.8 | 2.3 | 3.6 |
| 3 | Structure III | 0.08 | $CH_3$ | H | i-$C_8H_{17}$ | i-$C_8H_{17}$ | 0.3 | 1.6 | 5.0 |
| 4 | Structure IV | 0.07 | H | n-$C_7H_{15}$ | H | H | 0.3 | — | 2.1 |
| 5 | Structure I | 0.05 | H | H | | p-$C_4H_9$ | 0.2 | 0.5 | 3.5 |
| 6 | Structure I | 0.05 | H | H | H | p-$OCH_3$ | 0.1 | 0.3 | 1.2 |
| 7 | Structure I | 0.05 | H | H | H | m-$CH_3$ | 0.1 | — | 1.4 |
| 8 | Structure I | 0.05 | H | i-$C_3H_{17}$ | H | p-$CH_3$ | 0.1 | 0.4 | 2.0 |
| 9 | Structure I | 0.05 | H | i-$C_3H_7$ | H | p-$OCH_3$ | 0.3 | 0.4 | 1.2 |
| 10 | Structure I | 0.05 | H | i-$C_3H_7$ | H | p-$NO_2$ | 0.2 | 0.9 | 1.2 |
| 11 | Structure I | 0.08 | H | H | $CH_3$ | p-$OCH_3$ | 0.1 | — | 0.3 |

EXAMPLE 2

RBOT and UOT Tests on the Partially Formulated Oil

RBOT and UOT tests were performed on several formulations similar to those tested in Example 1. The results of these tests are shown in Table 2.

TABLE 2

| RBOT and UOT Test Results On Partially Formulated Oil | | | | | | | | |
|---|---|---|---|---|---|---|---|---|
| | | Wt % | Substituents in Structures I–IV | | | | RBOT Life | UOT Life |
| Run No. | Additive | Additive | $R_1$ | $R_2$ | $R_3$ | $R_4$ | (Min) | (Hr) |
| 12 | None | 0 | — | — | | — | 127 | 45 |
| 13 | Structure II | 0.08 | $CH_3$ | H | i-$C_8H_{17}$ | i-$C_8H_{17}$ | 395 | 115 |
| 14 | Structure III | 0.08 | $CH_3$ | H | i-$C_8H_{17}$ | i-$C_8H_{17}$ | 345 | 90 |
| 15 | Structure IV | 0.07 | H | n-$C_7H_{15}$ | H | H | 360 | 362 |
| 16 | Structure I | 0.05 | H | H | H | p-$C_4H_9$ | 500 | 350 |
| 17 | Structure I | 0.05 | H | H | H | p-$OCH_3$ | 575 | 610 |
| 18 | Structure I | 0.05 | H | H | H | m-$CH_3$ | 515 | 450 |
| 19 | Structure I | 0.05 | H | i-$C_3H_7$ | H | p-$CH_3$ | 545 | — |
| 20 | Structure I | 0.05 | H | i-$C_3H_7$ | H | p-$OCH_3$ | 525 | 422 |
| 21 | Structure I | 0.05 | H | i-$C_3H_7$ | H | p-$NO_2$ | 350 | 279 |
| 22 | Structure I | 0.08 | H | H | $CH_3$ | p-$OCH_3$ | 425 | 736 |
| 23 | Structure I | 0.08 | $CH_3$ | H | H | p-$OCH_3$ | 400 | 444 |
| 24 | Structure I | 0.08 | $CH_3$ | H | $CH_3$ | p-$OCH_3$ | 343 | 386 |

EXAMPLE 3

RBOT and UOT Tests on Solvent 150 Neutral Base Oil

ROBT and UOT Tests were performed on the Solvent 150 Neutral base oil (without the rust inhibitor and phenolic antioxidant) to which various benzotriazole compounds had been added. The results of these tests are shown in Table 3.

TABLE 3

| RBOT and UOT Test Results Using Solvent 150 Neutral Base Oil | | | | | | | | |
|---|---|---|---|---|---|---|---|---|
| | | Wt % | Substituents in Structures I–IV | | | | RBOT Life | UOT Life |
| Run No. | Additive | Additive | $R_1$ | $R_2$ | $R_3$ | $R_4$ | (Min) | (Hr) |
| 25 | Structure II | 0.08 | $CH_3$ | H | i-$C_8H_{17}$ | i-$C_8H_{17}$ | — | 33 |
| 26 | Structure IV | 0.06 | H | n-$C_7H_{15}$ | H | H | 73 | — |
| 27 | Structure I | 0.04 | H | H | H | m-$CH_3$ | 80 | — |
| 28 | Structure I | 0.05 | H | i-$C_3H_7$ | H | p-$CH_3$ | 88 | 32 |
| 29 | Structure I | 0.06 | H | i-$C_3H_7$ | H | p-$OCH_3$ | 130 | 97 |
| 30 | Structure I | 0.06 | H | i-$C_3H_7$ | H | p-$NO_2$ | 70 | 54 |
| 31 | Structure I | 0.05 | H | H | H | p-$OCH_3$ | 153 | 82 |

The data in Tables 1–3 show that benzotriazoles having a substituted aromatic group attached to the amine (rather than to the triazole) nitrogen atom (structure I) provide lubricants with greater oxidation stability than benzotriazoles having aliphatic groups attached to the amine nitrogen atom (structures II and III). In almost all tests, the aromatic substituted benzotriazoles have lower TOP's and longer RBOT and UOT lifetimes than the benzotriazoles with aliphatic groups (compare Run Nos. 2 and 3 in Table 1, Run Nos. 13 and 14 in Table 2, and Run No. 25 in Table 3 with the remaining runs in each table). This difference is particularly noteworthy in the UOT test results wherein the best aromatic substituted benzotriazoles having structure I show lifetimes 2–4 times those of benzotriazoles having structures II and III.

The data is Tables 1–3 also show that a further improvement in oxidation stability is obtained when the substituents on the aromatic ring attached to the amine nitrogen atom ($R_4$) supply electrons to the aromatic system. For example, the p-$OCH_3$ group is a strong electron doner such that the tests performed with this group have the best overall oxidation stability of the compounds tested (see Run Nos. 6, 9, and 11 in Table 1, Run Nos. 17, 20, and 22 in Table 2; and Run Nos. 29 and 31 in Table 3). Conversely, the p-$NO_2$ group is electron withdrawing and, overall, has the poorest oxidation stability (see Run Nos. 10, 21, and 28 in Tables 1-3). The alkyl phenyl derivatives are between these extremes.

EXAMPLE 4

Comparison of Oxidation Stability Data with Substituent Constants

RBOT and UOT lifetimes for certain benzotriazole compounds tested in Tables 2 and 3 were correlated with the substituent constants for those compounds. The results are summarized in Table 4 below in which the compounds are listed in increasing order of their ability to supply electrons (i.e. increasing negative $\sigma$ constants).

TABLE 4

Oxidation Test Results vs. Substituent Constant for Various Benzotriazoles

| | Substituents in Structures I and IV | | | | | Partially Formulated Oil | | Solvent 150N Base Oil |
|---|---|---|---|---|---|---|---|---|
| Run No. | $R_1$ | $R_2$ | $R_3$ | $R_4$ | $R_4$ $\sigma$ (1) | RBOT Life | UOT Life | RBOT Life (Hr) |
| 21 and 30 | H | i-$C_3H_7$ | H | p-$NO_2$ | +1.27 | 350 | 279 | 70 |
| 15 and 26 | H | n-$C_7H_{15}$ | H | H | 0 | 360 | 362 | 73 |
| 18 and 27 | H | H | H | m-$CH_3$ | −0.07 | 515 | 450 | 80 |
| 19 and 28 | H | i-$C_3H_7$ | H | p-$CH_3$ | −0.17 | 545 | — | — |
| 20 and 29 | H | i-$C_3H_7$ | H | p-$OCH_3$ | −0.27 | 525 | 422 | 130 |
| 17 and 31 | H | H | H | p-$OCH_3$ | −0.27 | 575 | 610 | 153 |

(1) From Hine, "Physical Organic Chemistry", McGraw-Hill Inc., N.Y. (1956); $\sigma$ is defined as the "substituent constant".

The data in Table 4 show that, in general, the oxidation stability of the compounds corresponds to their ability to donate electrons as measured by $\sigma$. In particular, the compound used in Run Nos. 17 and 29 (a methoxy substituted aromatic group) has especially good oxidation stability in all tests.

What is claimed is:

1. A lubricant composition comprising a major amount of a lubricating base oil and a minor amount of an additive having the formula:

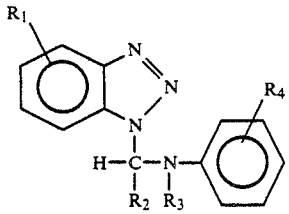

wherein $R_1$, $R_2$, and $R_3$ may be the same or different and are hydrogen or an alkyl group, and $R_4$ is a substituent having a substituent constant of less than zero.

2. The composition of claim 1 wherein the alkyl groups in $R_1$-$R_3$ each have from 1 to 20 carbon atoms.

3. The composition of claim 1 wherein $R_4$ is an alkyl, amido, amino, hydroxy, or thiol group, or a substituted derivative thereof.

4. The composition of claim 3 wherein $R_4$ is an alkyl group, hydroxy group, or a substituted derivative thereof.

5. The composition of claim 4 wherein the alkyl group or substituted derivative thereof in $R_4$ has from 1 to 20 carbon atoms.

6. The composition of claim 5 wherein $R_4$ is an alkoxy group having from 1 to 10 carbon atoms.

7. The composition of claim 6 wherein at least one of $R_1$, $R_2$, or $R_3$ is an alkyl group having from 1 to 10 carbon atoms.

8. The composition of claim 7 wherein at least one of $R_1$, $R_2$, and $R_3$ is an alkyl group having from 1 to 4 carbon atoms.

9. The composition of claim 8 wherein $R_1$ and $R_2$ are hydrogen.

10. The composition of claim 1 wherein from about 0.01 to about 5 weight % of the additive is present in the composition.

11. A lubricant composition comprising a major amount of an oil of lubricating viscosity and from about 0.02 to about 5 wt % of an additive having the formula:

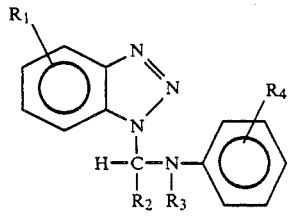

wherein $R_1$ is hydrogen or a straight chain alkyl group having from 1 to 4 carbon atoms, $R_2$ is hydrogen, $R_3$ is hydrogen or a straight chain alkyl group having from 1 to 4 carbon atoms, and $R_4$ is an alkyl group or an alkoxy group having from 1 to 4 carbon atoms.

12. The composition of claim 11 wherein from about 0.01 to about 2 wt. % the additive is present in the composition.

13. The composition of claim 11 wherein $R_1$ is hydrogen.

14. The composition of claim 13 wherein $R_4$ is an alkoxy group.

15. The composition of claim 14 wherein $R_4$ is an alkoxy group having from 1 to 3 carbon atoms.

16. The composition of claim 15 wherein $R_4$ is a methoxy group.

17. The composition of claim 13 wherein $R_3$ is an alkyl group and $R_4$ is $C_4H_9$.

18. The composition of claim 11 wherein $R_4$ is an alkyl group having from 1 to 3 carbon atoms.

19. A lubricant composition comprising a major amount of an oil of lubricating viscosity and from about 0.01 to about 1 wt. % of an additive having the formula

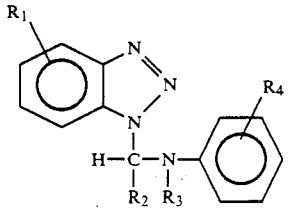

wherein $R_1$ is hydrogen or $CH_3$, $R_2$ is hydrogen, $R_3$ is hydrogen, $CH_3$, or $C_2H_5$, and $R_4$ is an alkyl group or an alkoxy group having from 1 to 4 carbon atoms in a straight chain.

20. The composition of claim 19 where $R_4$ is alkoxy.

21. The composition of claim 20 wherein $R_3$ is $CH_3$.

22. The composition of claim 21 wherein $R_1$ is hydrogen and $R_4$ is methoxy.

23. The composition of claim 21 wherein $R_1$ is $CH_3$ and $R_4$ is methoxy.

24. The composition of claim 19 wherein $R_1$ is hydrogen or $CH_3$.

25. The composition of claim 24 wherein $R_1$ is hydrogen.

26. The composition of claim 25 wherein $R_3$ is hydrogen and $R_4$ is $C_4H_9$.

* * * * *